US005146136A

United States Patent [19]

Ogura et al.

[11] Patent Number: 5,146,136

[45] Date of Patent: Sep. 8, 1992

[54] MAGNETRON HAVING IDENTICALLY SHAPED STRAP RINGS SEPARATED BY A GAP AND CONNECTING ALTERNATE ANODE VANE GROUPS

[75] Inventors: Toshio Ogura, Mobara; Masumi Kuga, Mutsusawamachi, both of Japan

[73] Assignees: Hitachi, Ltd., Tokyo; Hitachi Nisshin Electronics Co., Ltd., Chiba, both of Japan

[21] Appl. No.: 447,580

[22] Filed: Dec. 7, 1989

[30] Foreign Application Priority Data

Dec. 19, 1988 [JP] Japan ..... 63-318420

[51] Int. Cl.[5] ..... H01J 25/50

[52] U.S. Cl. ..... 315/39.69; 315/39.75

[58] Field of Search ..... 315/39.51, 39.69, 39.73, 315/39.75, 39.77

[56] References Cited

U.S. PATENT DOCUMENTS

| | | | |
|---|---|---|---|
| 2,635,209 | 4/1953 | Clogston | 315/39.69 |
| 2,983,843 | 5/1961 | LaRue et al. | 315/5.13 X |
| 3,121,821 | 2/1964 | Yu | 315/5.13 X |
| 3,423,632 | 1/1969 | Uchimaru et al. | 315/39.69 |
| 3,875,469 | 4/1975 | Sato et al. | 315/39.69 |

FOREIGN PATENT DOCUMENTS

| | | | |
|---|---|---|---|
| 166846 | 12/1980 | Japan | 315/39.51 |
| 214328 | 9/1986 | Japan | 315/39.69 |
| 66824 | 3/1988 | Japan | 315/39.69 |

*Primary Examiner*—Eugene R. LaRoche
*Assistant Examiner*—Benny T. Lee
*Attorney, Agent, or Firm*—Antonelli, Terry, Stout & Kraus

[57] ABSTRACT

There is disclosed a magnetron whose oscillation frequency can be easily adjusted. The magnetron comprises a cylindrical anode, several anode vanes radially arranged around the axis of the anode, and two strap rings of the same structure. Alternate ones of the anode vanes are connected together by one of the strap rings. The remaining anode rings are connected together by the other strap ring. The two strap rings are displaced circumferentially relative to each other by a given angle centering around the axis of the anode.

6 Claims, 2 Drawing Sheets

FIG. 5(a)
PRIOR ART
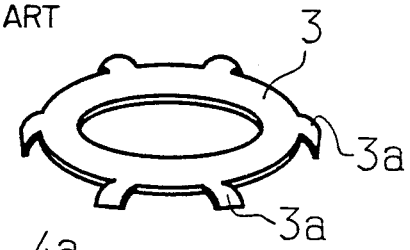
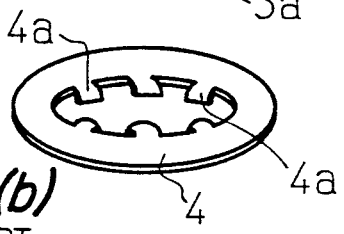
FIG. 5(b)
PRIOR ART
FIG. 6
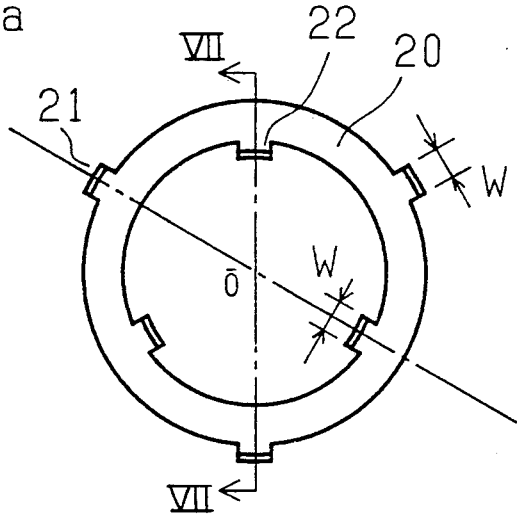
FIG. 7
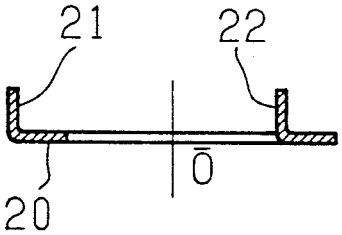
FIG. 9
FIG. 8
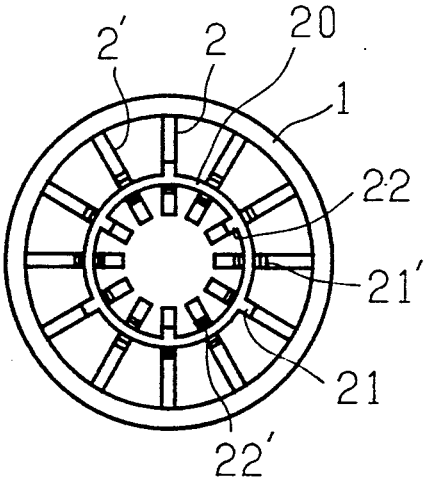
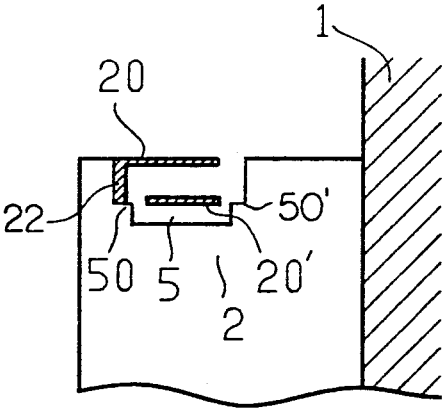

MAGNETRON HAVING IDENTICALLY SHAPED STRAP RINGS SEPARATED BY A GAP AND CONNECTING ALTERNATE ANODE VANE GROUPS

FIELD OF THE INVENTION

The present invention relates to a magnetron and, more particularly, to a magnetron whose oscillation frequency can be easily adjusted and which is equipped with strap rings that are easy to fabricate.

BACKGROUND OF THE INVENTION

A magnetron which is frequently used as an RF wave source has a plurality of anode vanes on its anode. Alternate anode vanes are electrically connected together to form plural resonant cavities, as disclosed in U.S. Pat. No. 3,553,524.

To connect together alternate anode vanes, cutouts are formed at the side fringes of the vanes, and two rings of different diameters are inserted in the cutouts. The rings are joined to the fringes of alternate cutouts in the anode vanes.

FIG. 1 is a plan view of main portions of a conventional magnetron. This magnetron comprises an anode 1, anode vanes 2, 2', a first strap ring 3, a second strap ring 4, and cutouts 5, 5' formed at the fringes of the anode vanes. The anode vanes 2 and 2' extend toward the center $\overline{0}$ from the inner wall of the anode 1. The anode vanes are arranged radially around the axis passing through the center $\overline{0}$. The alternate anode vanes 2 are connected together by the first strap ring 3, while the remaining anode vanes 2' are connected together by the second strap ring 4 that is different in diameter from the first ring 3.

FIGS. 2(*a*)–2(*b*) are perspective views of the strap rings. The larger one is the first strap ring 3. The smaller one is the second strap ring 4.

FIGS. 3 and 4 are side elevations of the anode vanes and the strap rings, for showing their connection. FIG. 3 shows the manner in which the anode vanes 2 (only one is shown) are connected together by the smaller second strap ring 4. A cutout 5 is formed at each side fringe of the anode vane 2. One side wall of the cutout 5 is defined by a step 50 over which the second strap ring 4 fits.

FIG. 4 shows the manner in which the anode vanes 2' (only one is shown) are tied together by the larger first strap ring 3. A cutout 5' is formed at each side fringe of the anode vanes 2'. One side wall of the cutout 5' is formed by a step 50'. The first strap ring 3 fits over the step 50'. In this way, the alternate anode vanes 2 are connected together. Also, the alternate anode vanes 2' are connected together.

FIGS. 5(*a*)–5(*b*) are perspective view of another known set of strap rings. FIG. 5(*a*) shows the first strap ring 3, while FIG. 5(*b*) shows the second strap ring 4. The first ring 3 has the same diameter as the second ring 4. A plurality of outer tongues 3*a* are formed on the outer periphery at positions corresponding to the positions of alternate anode vanes. The tongues 3*a* protrude from the outer periphery, and are bent in one direction. Inner tongues 4*a* are formed on the inner surface of the second strap ring 4 at positions corresponding to the remaining anode vanes. The strap rings 3 and 4 are fitted in the cutouts 5 and 5', respectively, formed in the anode venes 2 and 2', respectively, to couple together alternate anode vanes. The oscillation frequency is determined and the operation is stabilized by adjusting the electrostatic capacitance between the first strap ring and the second strap ring.

In the aforementioned prior art techniques, it is necessary to fabricate the first and second strap rings as separate parts. It is difficult to adjust the oscillation frequency and to stabilize the operation with two strap rings of different diameters or shapes. Further, fabricating two kinds of strap rings increases the cost of the parts.

SUMMARY OF THE INVENTION

It is an object of the present invention to provide a magnetron which is free from the foregoing problems of the prior art techniques. The present invention makes it easy adjust the oscillation frequency and stabilize the operation, and is equipped with strap rings that are economical to fabricate.

The above object is achieved by a magnetron having n anode vanes and two strap rings of the same construction, the strap rings being disposed in a back-to-back relation to couple together alternate anode vanes and to couple together, the remaining anode vanes, respectively each strap ring having n/2 tongues alternately protruding inward and outward, the tongues being formed corresponding to the positions of alternate anode vanes.

Generally, the number of anode vanes n is 8 or more. The tongues which protrude from the inner surface and the outer surface of a ring are spaced $2\times360°/n$ from each other and are bent through about 90° from the plane of the ring.

In order to connect together alternate ones of the n anode vanes and to connect together the remaining anode vanes, two strap rings of the same construction are used. Each strap ring has n/4 tongues on its outer surface and, n/4 tongues on its inner surface. These tongues are arranged radially around the center $\overline{0}$ of the ring such that the outer tongues alternate with the inner tongues. The two strap rings are arranged opposing each other with a gap therebetween. The strap rings are so mounted that the tongues are fitted in the cutouts formed in the anode vanes. The electrostatic capacitance between the two strap rings is adjusted and the oscillation frequency is set by adjusting the space between the two strap rings. Since the two used strap rings have the same construction, the oscillation frequency can be easily adjusted. Also, the stability of the operation is improved. Further, the cost of the strap rings can be reduced.

BRIEF DESCRIPTION OF THE DRAWINGS

FIGS. 5(*a*)–5(*b*) are perspective views of another conventional set of strap rings;

FIG. 6 is a plan view of a strap ring for use in a magnetron according to the invention;

FIG. 7 is a cross-sectional view taken on line VII—VII of FIG. 6;

FIG. 8 is a plan view of anode vanes connected together by strap rings according to the invention; and FIG. 9 is a cross-sectional view of a portion of a magnetron in which an anode vane is connected to a strap ring according to the invention.

DETAILED DESCRIPTION OF THE INVENTION

Figure 1:
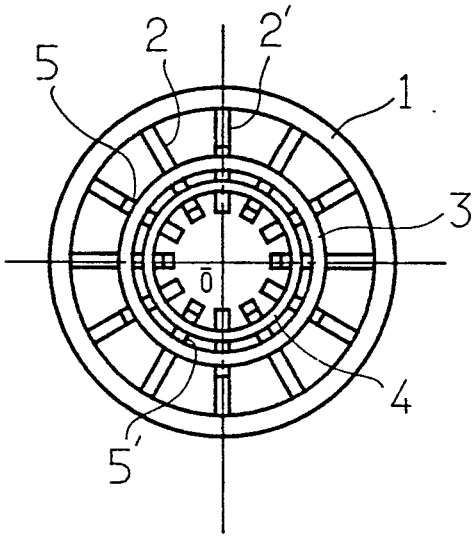
FIG. 1 PRIOR ART
FIG. 1 is a plan view of main portions of a conventional magnetron.
Figure 2B:
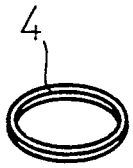
FIG. 2(b) PRIOR ART
FIGS. 2(*a*)–2(*b*) are perspective views of a known set of strap rings.
Figure 2A:
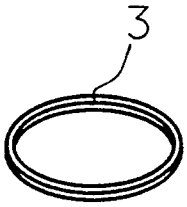
FIG. 2(a) PRIOR ART
Figure 3:
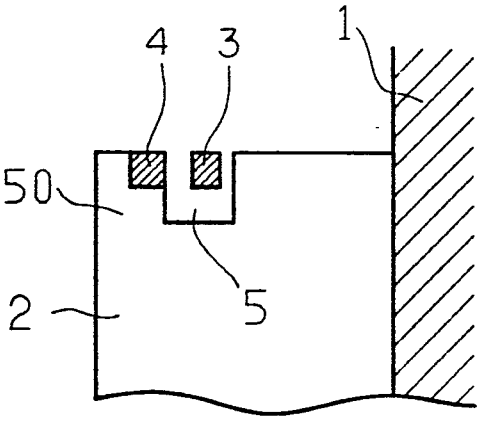
FIG. 3 PRIOR ART
FIGS. 3 and 4 are side elevations of main portions of anode vanes and strap rings, for showing the manner in which they are connected by the prior art techniques.
Figure 4:
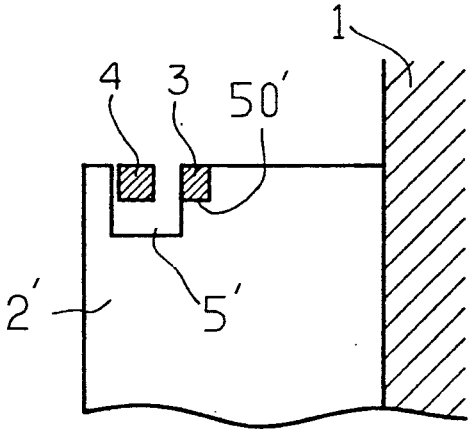
FIG. 4 PRIOR ART

Referring to FIG. 6, there is shown a strap ring for use in a magnetron according to the invention. The strap ring, generally indicated by numeral 20, is annular in form and has outer tongues 21 and inner tongues 22. The total number of the tongues 21 and 22 is equal to n/2 or half of the number of the anode vanes n. The number of the outer tongues 21 is n/4. Also, the number of the inner tongues 22 is n/4. The tongues 21 and 22 are circumferentially spaced $2\times360°/n$ from each other around the center $\bar{0}$ of the ring. Of course, the anode vanes are spaced 360°/n from each other. The width w, or the circumferential dimension, of each of the outer tongues 21 and the inner tongues 22 is made substantially equal to the wall thickness of each anode vane. If the width w of each tongue is considerably smaller than the wall thickness of each anode vane, then flow of heat between the strap ring and each anode vane is hindered. Conversely, if the width w of each tongue is considerably larger than the wall thickness of each anode vane, then it is difficult to electrically insulate the tongues of the strap ring from the anode vanes or to insulate the tongues of one strap ring from the tongues of the other strap ring.

FIG. 7 is a cross-sectional view taken on the line VII-VII of FIG. 6. The outer tongues 21 and the inner tongues 22 are bent through about 90° from the plane of the strap ring 20 and extend in the same direction.

FIG. 8 is a plan view of a magnetron in which anode vanes are connected together by strap rings according to the invention. The magnetron comprises an anode 1, anode vanes 2, 2', a first strap ring 20, and a second strap ring 20' which is shown in FIG. 9. The first ring 20 has outer tongues 21 and inner tongues 22. The second ring 20' has outer tongues 21' and inner tongues 22'.

FIG. 9 is a cross-sectional view of a portion of a magnetron in which an anode vane is are connected to a strap ring according to the invention. Shown in this figure are an anode 1, an anode vane 2, a cutout 5 formed at a side fringe of the vane 2, a first strap ring 20, and a second strap ring 20'. The first ring 20 has an outer tongue 21. The second ring 20' has the same structure as the first ring 20 but is inverted. The two strap rings 20 and 20' are disposed opposing each other with a gap therebetween.

In FIG. 9, an inner tongue 22 of the first strap ring 20 is coupled to an inner step 50 formed in a cutout 5 in an anode vane 2. An outer tongue 21' of the second strap ring 20' (not shown in FIG. 9) is coupled to an outer step 50' formed in a cutout 5 in a neighboring anode vane 2' (not shown in FIG. 9). Thus, alternate anode vanes 2 of the n anode vanes are connected together by the n/2 outer and inner tongues 21 and 22 of the first strap ring 20. The remaining anode vanes 2' are connected together by the n/2 outer and inner tongues 21' and 22' of the second strap ring 20'.

After the strap rings having the same shape are coupled to the anode vanes, the oscillation frequency of the magnetron is set and the operation is stabilized by adjusting the space between the first strap ring 20 and the second strap ring 20' or their positional relation.

As described thus far, alternate anode vanes are connected together by a first strap ring, the remaining anode vanes being connected together by a second strap ring having the same structure as the first ring. Therefore, the two strap rings are standardized. This leads to a reduction in the cost. Further, since the two strap rings have the same shape, it is easy to adjust the oscillation frequency and to stabilize the oscillation. Hence, a magnetron which is free of the foregoing problems and has excellent functions can be offered.

What is claimed is:

1. A magnetron comprising:

a cathode;

a cylindrical anode having an axis, the anode having an inner wall;

a plurality of anode vanes disposed on the inner wall of the anode and extending towards the axis of the anode, the anode vanes having respective edges and being provided with respective cutouts in the edges, the anode vanes being grouped into first alternate anode vanes and second alternate anode vanes, the first alternate anode vanes alternating with the second alternate anode vanes;

a first strap ring connecting together the first alternate anode vanes at the cutouts of the first alternate anode vanes; and a second strap ring connecting together the second alternate anode vanes at the cutouts of the second alternate anode vanes;

wherein the first and second strap rings each lie in a respective plane oriented transverse to the axis of the anode; each strap ring having an inner surface facing towards the axis of the anode and an outer surface facing away from the axis of the anode; and each strap ring is provided with a plurality of inner tongues protruding from the inner surface of the strap ring and extending in a direction away from the respective plane of the strap ring, and a plurality of outer tongues protruding from the outer surface of the strap ring and extending away from the respective plane of the strap ring in the direction in which the inner tongues extend, the inner tongues alternating with the outer tongues; and wherein the first and second strap rings are disposed in the cutouts of the anode vanes such that the first and second strap rings oppose each other with a gap therebetween, and such that the inner and outer tongues of the first strap ring contact respective ones of the first alternate anode vanes at the cutouts of the respective first alternate anode vanes, and the inner and outer tongues of the second strap ring contact respective ones of the second alternate anode vanes at the cutouts of the respective second alternate anode vanes.

2. A magnetron according to claim 1, wherein each of the anode vanes has a wall thickness, each of the first and second strap rings extends in a circumferential direction around the axis of the anode, and each of the inner and outer tongues of the first and second strap rings has a width extending in the circumferential direction of the first and second strap rings which is equal to the wall thickness of each of the anode vanes.

3. A magnetron comprising:

a cathode;

a cylindrical anode having an axis, the anode having an inner wall;

a plurality of anode vanes disposed on the inner wall of the anode, the anode vanes having respective edges and being provided with respective cutouts in the edges, each of the cutouts having steps and a predetermined shape, the predetermined shape being the same for all of the cutouts, the anode vanes being grouped into first alternate anode vanes and second alternate anode vanes, the first alternate anode vanes alternating with the second alternate anode vanes;

a first strap ring having a predetermined shape and being disposed in the cutouts of the anode vanes so as to connect together the first alternate anode vanes; and a second strap ring having the same predetermined shape as the first strap ring and being disposed in the cutouts of the anode vanes so as to connect together the second alternate anode vanes;

wherein the first and second strap rings each lie in a respective plane oriented transverse to the axis of the anode; each strap ring having an inner surface facing towards the axis of the anode and an outer surface facing away from the axis of the anode; and each strap ring is provided with a plurality of inner tongues protruding from the inner surface of the strap ring and a plurality of outer tongues protruding from the outer surface of the strap ring, the inner tongues alternating with the outer tongues, and wherein the first and second strap rings are disposed in the cutouts of the anode vanes such that the first and second strap rings oppose each other with a gap therebetween, and such that the inner and outer tongues of the first strap ring contact respective ones of the first alternate anode vanes at the cutouts of the respective first alternate anode vanes, and the inner and outer tongues of the second strap ring contact respective ones of the second alternate anode vanes; and cutouts of the respective second alternate anode vanes; and wherein each of the anode vanes has a wall thickness, each of the first and second strap rings extends in a circumferential direction around the axis of the anode, and each of the inner and outer tongues of the first and second strap rings has a width extending in the circumferential direction of the first and second strap rings which is equal to the wall thickness of each of the anode vanes.

4. A magnetron comprising:

a cathode;

a cylindrical anode having an axis, the anode having an inner wall;

a plurality of anode vanes disposed on the inner wall of the anode, the anode vanes having respective edges and being provided with respective cutouts in the edges, each of the cutouts having steps and a predetermined shape, the predetermined shape being the same for all of the cutouts, the anode vanes being grouped into first alternate anode vanes and second alternate anode vanes, the first alternate anode vanes alternating with the second alternate anode vanes;

a first strap ring having a predetermined shape an being disposed in the cutouts of the anode vanes so as to connect together the first alternate anode vanes; and a second strap ring having the same predetermined shape as the first strap ring and being disposed in the cutouts of the anode vanes so as to connect together the second alternate anode vanes;

wherein the first and second strap rings each lie in a respective plane oriented transverse to the axis of the anode; each strap ring having an inner surface facing towards the axis of the anode and an outer surface facing away from the axis of the anode; and each strap ring is provided with a plurality of inner tongues protruding from the inner surface of the strap ring and a plurality of outer tongues protruding from the outer surface of the strap ring, the inner tongues alternating with the outer tongues, and wherein the first and second strap rings are disposed in the cutouts of the anode vanes such that the first and second strap rings oppose each other with a gap therebetween, and such that the inner and outer tongues of the first strap ring contact respective ones of the first alternate anode vanes at the cutouts of the respective first alternate anode vanes, and the inner and outer tongues of the second strap ring contact respective ones of the second alternate anode vanes at the cutouts of the respective second alternate anode vanes; and wherein the inner tongues of each of the first and second strap rings extend in a direction away from the respective plane of the strap ring, and the outer tongues of each of the first and second strap rings extends away from the respective plane of the strap ring in the direction in which the inner tongues extend.

5. A magnetron according to claim 4, wherein the first and second strap rings are disposed in the cutouts of the anode vanes such that the inner and outer tongues of the first strap ring extend towards the second strap ring, and the inner and outer tongues of the second strap ring extend towards the first strap ring.

6. A magnetron comprising:

a cathode;

a cylindrical anode having an axis, the anode having an inner wall;

a plurality of anode vanes disposed on the inner wall of the anode, the anode vanes having respective edges and being provided with respective cutouts in the edges, each of the cutouts having steps and a predetermined shape, the predetermined shape being the same for all of the cutouts, the anode vanes being grouped into first alternate anode vanes and second alternate anode vanes, the first alternate anode vanes alternating with the second alternate anode vanes;

a first strap ring having a predetermined shape and being disposed in the cutouts of the anode vanes so as to connect together the first alternate anode values; and a second strap ring having the same predetermined shape as the first strap ring and being disposed in the cutouts of the anode vanes so as to connect together the second alternate anode vanes;

wherein the first and second strap rings each lie in a respective plane oriented transverse to the axis of the anode; each strap ring having an inner surface facing towards the axis of the anode and an outer surface facing away from the axis of the anode; and each strap ring is provided with a plurality of inner tongues protruding from the inner surface of the strap ring and a plurality of outer tongues protruding from the outer surface of the strap ring, the inner tongues alternating with the outer tongues, and wherein the first and second strap rings are disposed in the cutouts of the anode vanes such that the first and second strap rings oppose each other with a gap therebetween, and such that the inner and outer tongues of the first strap ring contact respective ones of the first alternate anode vanes at the cutouts of the respective first alternate anode vanes, and the inner and outer tongues of the second strap ring contact respective ones of the second alternate anode vanes at the cutouts of the respective second alternate anode vanes;

wherein the anode vanes extend towards the axis of the anode, wherein each of the cutouts in the anode vanes has an inner side disposed towards the axis of the anode, and an outer side disposed away from the axis of the anode, and wherein the steps of each of the cutouts include an inner step at the inner side of the cutout and an outer step at the outer side of the cutout; and wherein the first and second strap rings are disposed in the cutouts of the anode vanes such that the inner tongues of the first step ring contact the respective first alternate anode vanes at the inner steps of the cutouts of the respective first alternate anode vanes, the outer tongues of the first strap ring contact the respective first alternate anode vanes at the outer steps of the cutouts of the respective first alternate anode vanes, the inner tongues of the second strap ring contact the respective second alternate anode vanes at the inner steps of the cutouts of the respective second alternate anode vanes, and the outer tongues of the second strap ring contact the respective second alternate anode vanes at the outer steps of the cutouts of the respective second alternate anode vanes.

* * * * *